US005957785A

United States Patent [19]

Masutani et al.

[11] Patent Number: 5,957,785

[45] Date of Patent: Sep. 28, 1999

[54] GOLF BALLS WITH DEFINED COATING LAYER

[75] Inventors: Yutaka Masutani; Keisuke Ihara; Hirotaka Shimosaka; Michio Inoue; Atuki Kasasima, all of Saitama, Japan

[73] Assignee: Bridgestone Sports Co., Ltd., Tokyo, Japan

[21] Appl. No.: 08/840,294

[22] Filed: Apr. 14, 1997

[30] Foreign Application Priority Data

Apr. 15, 1996 [JP] Japan ..... 8-117060

[51] Int. Cl.[6] ..... A63B 37/14

[52] U.S. Cl. ..... 473/377; 473/383; 473/365; 473/378

[58] Field of Search ..... 473/365, 377, 473/378, 383, 384

[56] References Cited

U.S. PATENT DOCUMENTS

| | | | |
|---|---|---|---|
| 3,177,280 | 4/1965 | Fort et al. | 473/378 X |
| 5,506,004 | 4/1996 | Maruoka et al. | 473/378 X |
| 5,669,831 | 9/1997 | Lutz | 473/378 X |
| 5,743,818 | 4/1998 | Maruoka et al. | 473/378 |
| 5,744,579 | 4/1998 | Lutz | 473/374 |

*Primary Examiner*—George J. Marlo
*Attorney, Agent, or Firm*—Sughrue, Mion, Zinn Macpeak & Seas, PLLC

[57] ABSTRACT

A golf ball has a coating layer formed by dispersion coating at the surface portion thereof. For example, a two-piece golf ball is produced by enclosing a solid core with a cover material; forming, by dispersion coating, a white coating layer made of a thermoplastic resin on the surface of the cover material; conducting mark stamping on the coating layer; forming, by dispersion coating, a transparent coating layer made of a thermosetting resin as an outermost layer; and then conducting dimple processing. The coatings have thicknesses in the range of 15–250 μm. Even when the coating layer at a surface portion is formed relatively thick, the coating layer allows the dimples to be precisely shaped and sharp edged and can be given sufficient durability and functions to improve travel properties, spin properties, and feel on impact. The coating layer is formed by dispersion coating using a water system emulsion which is prepared by dispersing a resin powder in water and wherein the resin powder has a gram size 1–3 μm.

12 Claims, 2 Drawing Sheets

GOLF BALLS WITH DEFINED COATING LAYER

BACKGROUND OF THE INVENTION

1. Field of the Invention

The present invention relates to a golf ball having a specific coating layer at its surface portion, which allows dimples to be precisely shaped and sharp edged and which can be given sufficient durability and functions to improve travel properties, spin properties, and feel on impact. This invention also relates to a production process thereof.

2. Related Art

Two-piece golf balls, three-piece golf balls, and thread-wound golf balls are usually produced by a process which comprises enclosing a solid core or a thread-wound core with a cover material and forming dimples by compression or injection molding, applying a coating on the surface of the cover material, conducting mark stamping by a transfer printing method, and then forming an outermost layer coating of the ball. In some cases, the mark stamp may be directly applied to the cover material surface, and then an outermost layer coating may be formed. One-piece golf balls are produced by a process which comprises preparing a solid core having dimples by compression or injection molding, and then subjecting the solid core to mark stamping and application of an outermost layer coating of the ball in this order.

In this case, the coating on the surface of the cover material and the outermost layer coating of the ball use a thermosetting coating material or a two-pack system coating material. Since coatings formed of these coating materials cannot be easily deformed by the application of heat and pressure, dimples cannot be easily formed after formation of such coatings. Therefore, the coating step is performed after dimples are formed.

However, the above-described conventional coating formed on the cover material or outermost layer coating of a ball is formed to protect the golf ball from dirt or scratches and to improve the appearance thereof. No attempts have been made to give these coatings functions to improve travel properties, spin properties, and feel on impact.

By contrast, the present inventors approached an idea to give a coating at a ball surface portion functions to improve travel properties, spin properties, and feel on impact of a golf ball. In order to give the coating such functions, the coating must accordingly be made thicker. At the same time, the coating must have sufficient durability to maintain the functions.

However, when the coating step is performed after formation of dimples as conventionally practiced, the coating shallows the dimples and dulls dimple edges if formed relatively thick on dimples. This impairs preciseness of a dimple shape. Accordingly, coating thickness must be made as thin as possible in order to prevent the coating from impairing preciseness of the dimple shape. Thus, it is difficult for a coating to have a thickness such as to have sufficient durability and functions to improve travel properties, spin properties, and feel on impact.

SUMMARY OF THE INVENTION

The present invention was made in view of the above problems, and has the object of providing a golf ball whose coating at the surface portion, even when formed relatively thick, allows dimples to be precisely shaped and sharp edged and can be given sufficient durability and functions to improve travel properties, spin properties, and feel on impact, and a production process thereof.

To achieve the above object, the present invention provides a golf ball comprising a coating layer formed by dispersion coating at the surface portion thereof. Preferably, the golf ball of the present invention comprises a main body and one or more coating layers formed on the main body, at least one of the coating layers being formed by dispersion coating.

The present invention also provides a process for producing a golf ball which comprises forming, by dispersion coating, a coating layer made of a thermoplastic resin and/or a thermosetting resin on the surface of a main body of a golf ball in which dimples have not been formed, and then forming dimples by compression molding.

The term "main body" as used herein means a solid core enclosed with a cover in the case of two-piece or three-piece golf balls, a thread-wound core enclosed with a cover in the case of thread-wound golf balls, and a solid core itself in the case of one-piece golf balls.

Dispersion coating is a lining method wherein a resin powder is dispersed in water or an organic solvent together with an adequate additive, the resulting emulsion is applied onto the surface of a material by a dipping method or a spraying method, and drying the coated material, followed by heating at a predetermined temperature to form a coating.

A coating layer formed by dispersion coating at the surface portion of a golf ball allows dimples to be formed by compression molding. Thus, according to the present invention, precisely shaped, sharp-edged dimples can be formed without lowering of preciseness of the dimple shape which would otherwise result due to coating after formation of dimples, thereby improving travel properties of a golf ball. That is, since a coating layer of a thermoplastic resin formed by dispersion coating easily deforms by application of heat and pressure, dimples can be formed by application of heat and pressure after a coating layer is formed. Precisely shaped dimples can thus be obtained. A coating layer of a thermosetting resin formed by dispersion coating also allows dimples to be precisely shaped for the following reason. An emulsion formed by dispersing a thermosetting resin powder in water or organic solvent is applied to the surface portion of a golf ball, followed by drying to form a coating layer. This coating can be thermally set while dimples are formed on the cover material through the coating layer by compression molding with heat.

In the present invention, by properly selecting a thermoplastic resin or thermosetting resin to be dispersion coated and by properly selecting coating thickness to thereby properly choose properties of the coating, the coating layer can be given sufficient durability and functions to improve travel properties, spin properties, and feel on impact. In this case, since a considerably thick coating layer can be formed through dispersion coating, the ratio of a coating volume to a golf ball volume can be made relatively large. Thus, the properties of the coating layer can favorably influence golf ball travel properties, spin properties, and feel on impact, and the coating layer can be given a sufficient durability.

Therefore, according to the golf balls and their production process of the present invention, even when the coating layer at the surface portion is formed relatively thick, the coating layer allows dimples to be precisely shaped and sharp edged and can be given sufficient durability and functions to improve travel properties, spin properties, and feel on impact.

DESCRIPTION OF THE PREFERRED EMBODIMENTS

The present invention will be described in detail below.

In the present invention, the type of emulsion to be applied by dispersion coating is not particularly limited. A resin powder for preparing an emulsion may be either a thermoplastic resin powder or a thermosetting resin powder. Examples of such a resin powder include vinyl acetate resin powders, vinyl acetate copolymer resin powders, EVA (ethylene-vinyl acetate copolymer resin) powders, acrylic ester (co)polymer resin powders, epoxy resin powders, thermosetting urethane resin powders, and thermoplastic urethane resin powders. Particularly preferred are epoxy resin powders, thermosetting urethane resin powders, thermoplastic urethane resin powders, and acrylic ester (co) polymer resin powders. Most preferred are thermoplastic urethane resin powders, in view of excellent moldability for forming dimples and excellent durability of a coating layer formed thereof.

Properties of a resin powder used for dispersion coating are not particularly limited. In view of easy regulation of coating thickness and easy sintering, the grain size of a resin powder is usually 0.1 to 100 $\mu$m, preferably 1 to 30 $\mu$m.

As a dispersion coating method, i.e a method of applying a resin powder-dispersed liquid onto surface to be treated, there can be used any method such as a spraying method, a disc coater method, a dipping method, or a bell method.

Figure 1:
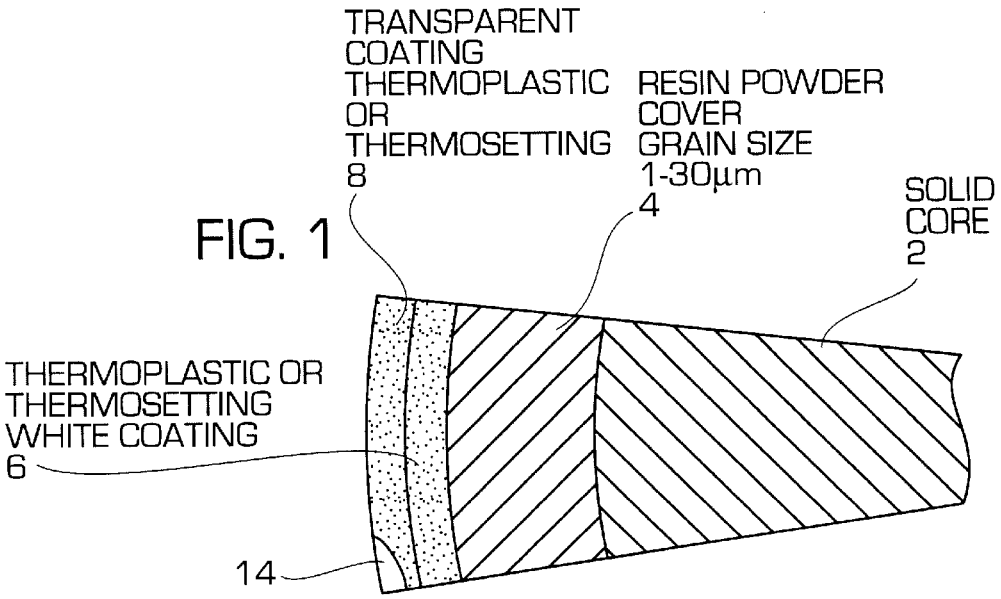
FIG. 1 is a partially enlarged sectional view showing a golf ball according to an embodiment of the present invention.

The thickness of a coating layer formed by dispersion coating is preferably 15 to 250 $\mu$m, particularly 50 to 100 $\mu$m. When coating thickness is thinner than 15 $\mu$m, durability of the coating layer may deteriorate. When the thickness exceeds 250 $\mu$m, the coating layer may crack or remain green (poorly dried). When two layers of coating are formed by dispersion coating (for example, as seen in FIG. 1), the thickness of each coating layer may fall within the above-described ranges.

In conventional coating, to prevent lowering of preciseness of the dimple shape (as already mentioned), the coating thickness is kept very thin at about 10 $\mu$m. This thin coating layer functions to protect the golf balls and to improve their appearance. Contrary to this, according to the present invention, by making a coating layer formed by dispersion coating thicker in the range of 15 to 250 $\mu$m, the coating layer is given sufficient durability and functions to improve travel properties, spin properties, and feel on impact as well as functions to protect the golf ball and to improve appearance. A conventional injection molding method cannot form such a thin cover as coating layer implemented by the present invention.

In the production process of golf balls of the present invention, dispersion coating is applied to, for example, the following steps, but is not limited thereto.

① In two-piece or three-piece golf balls and thread-wound golf balls, when a coating is applied onto a cover material surface, and then mark stamping is carried out, followed by application of an outermost layer coating of a golf ball, the coating on the cover material surface and/or the outermost layer coating is formed by dispersion coating.

② In two-piece or three-piece golf balls and thread-wound golf balls, when a mark is directly stamped onto the bare cover material surface, and then an outermost layer coating of a golf ball is formed, the outermost layer coating is formed by dispersion coating.

③ In one-piece golf balls, an outermost layer coating is formed by dispersion coating.

When a coating layer formed by dispersion coating is considered as a thin cover, the above-described two-piece golf ball may be considered as a three-piece golf ball having so thin an outermost cover that cannot be formed by injection molding. Likewise, the above-described one-piece golf ball may be considered as a two-piece golf ball having so thin a cover that cannot be formed by injection molding.

In the present invention, by properly selecting the properties of a coating layer formed by dispersion coating, the coating layer can be given functions to improve travel properties, spin properties, and feel on impact. For example, in two-piece or three-piece golf balls and thread-wound golf balls, when an outermost layer coating is applied by dispersion coating, and hardness of the coating layer is made less than that of a cover, the coating layer can be given improved spin properties of the golf ball.

The present invention will be described in detail with reference to the drawings.

Figure 3:
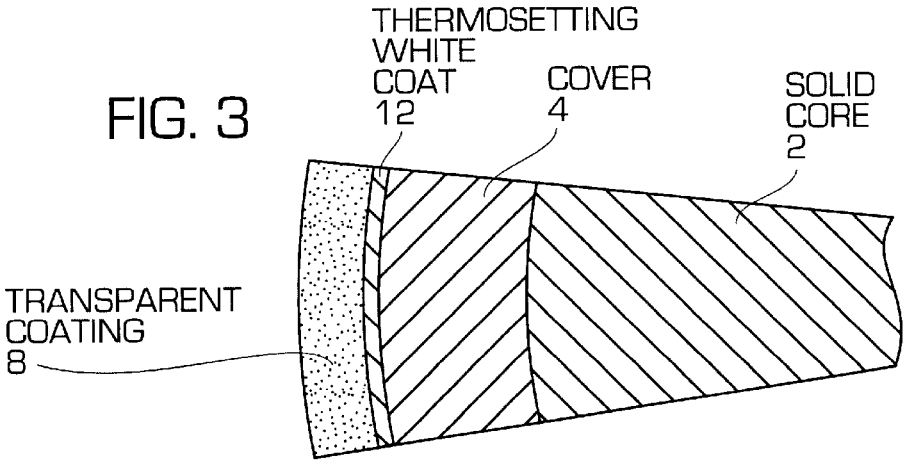
FIG. 3 is a partially enlarged sectional view showing a golf ball according to a further embodiment of the present invention.
Figure 4:
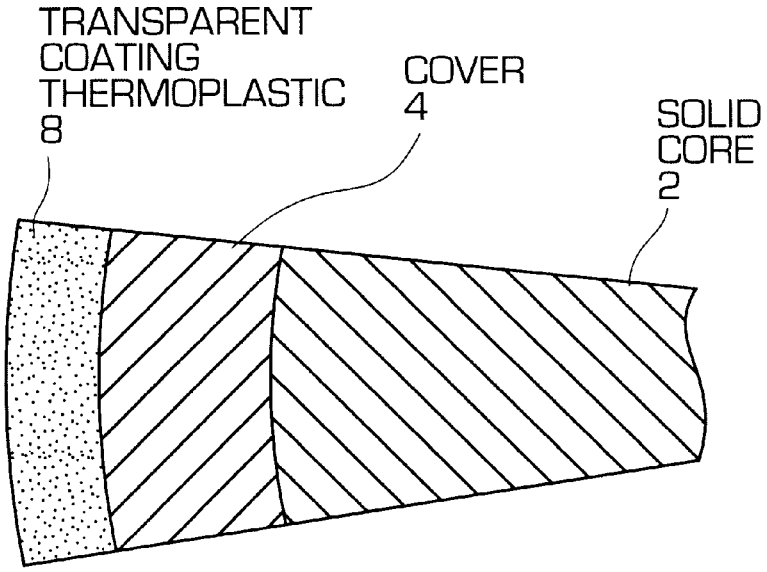
FIG. 4 is a partially enlarged sectional view showing a golf ball according to a further embodiment of the present invention.
Figure 5:
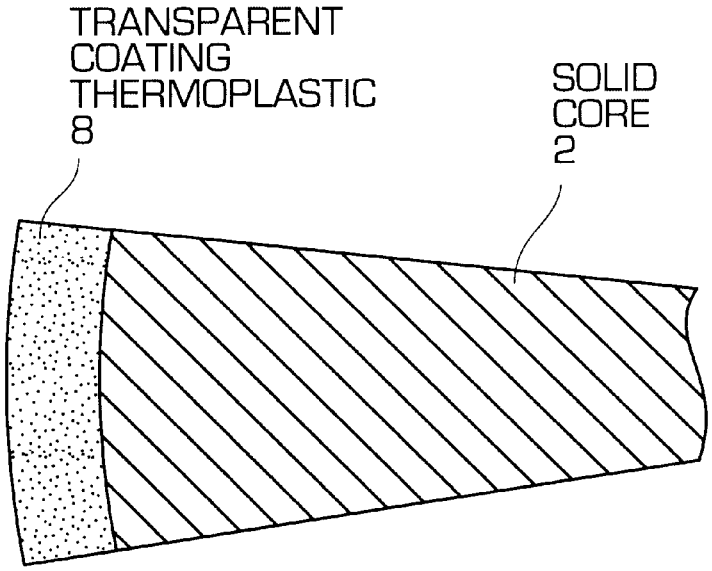
FIG. 5 is a partially enlarged sectional view showing a golf ball according to a further embodiment of the present invention.

FIGS. 1 to 5 are partially enlarged views showing golf balls according to embodiments of the present invention. FIGS. 1 to 4 show embodiments of two-piece golf balls. FIG. 5 shows an embodiment of a one-piece golf ball. Three-piece golf balls and thread-wound golf balls may be constructed in a manner similar to the two-piece golf balls of FIGS. 1 to 4. In addition, a mark to be formed by mark stamping is not shown in FIGS. 1 to 5.

The two-piece golf ball as shown in FIG. 1 may be prepared by enclosing a solid core 2 with a cover material 4; forming, by dispersion coating, a white coating layer 6 made of a thermoplastic resin on the surface of the cover material 4; conducting mark stamping on the coating layer 6; forming, by dispersion coating, a transparent coating layer 8 made of a thermosetting resin as an outermost layer; and then conducting dimple processing. The portion of a dimple is shown as element 14. In addition, in the two-piece golf balls as shown in FIG. 1, the coating layer 6 may be made of a thermosetting resin, and the coating layer 8 may be made of a thermoplastic resin. Both the coating layers 6 and 8 may be made of a thermoplastic resin or thermosetting resin.

Figure 2:
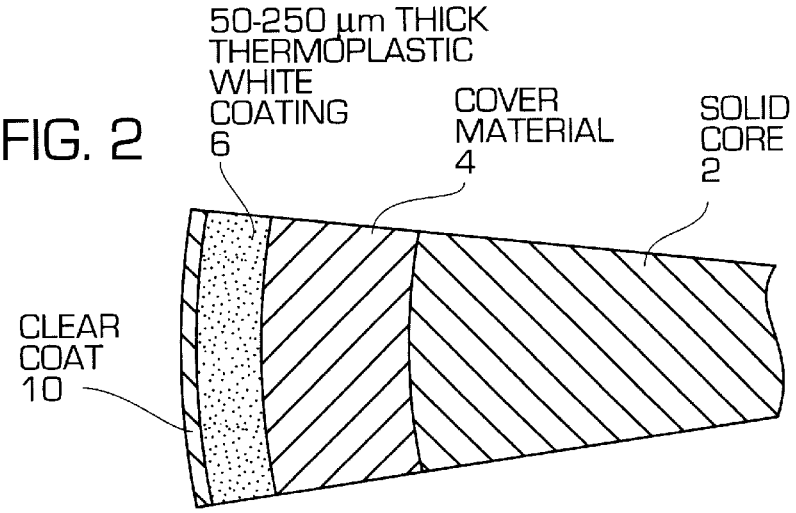
FIG. 2 is a partially enlarged sectional view showing a golf ball according to another embodiment of the present invention.

The two-piece golf ball as shown in FIG. 2 may be prepared by enclosing a solid core 2 with a cover material 4; forming, by dispersion coating, a white coating layer 6 made of a thermoplastic resin on the surface of the cover material 4; conducting dimple processing through the coating layer 6; conducting mark stamping on the coating layer 6; and forming a clear, conventional coating 10 as an outermost layer of the ball.

The two-piece golf ball as shown in FIG. 3 may be prepared by enclosing a solid core 2 with a cover material 4; forming a conventional white coating layer 12 made of a thermosetting coating material or two-pack system coating material on the surface of the cover material 4; conducting mark stamping on the coating layer 12; forming, by dispersion coating, a transparent coating layer 8 made of a thermoplastic resin as an outermost layer of the ball; and finally conducting dimple processing.

The two-piece golf ball as shown in FIG. 4 may be prepared by enclosing a solid core 2 with a cover material 4; conducting mark stamping directly on the surface of the cover material 4; forming, by dispersion coating, a transparent coating layer 8 made of a thermoplastic resin as an outermost layer of the ball; and finally conducting dimple processing.

The one-piece golf ball as shown in FIG. 5 may be prepared by conducting mark stamping on the surface of a solid core 2; forming, by dispersion coating, a transparent coating layer 8 made of a thermoplastic resin as an outermost layer of the ball; and finally conducting dimple processing.

EXAMPLES

Two-piece golf balls as indicated in FIG. 2 were prepared in the above-mentioned procedure. In this case, as emulsion to be applied by dispersion coating, REZAMIN #2515 (a water system emulsion prepared by dispersing a thermoplastic urethane resin in water) manufactured by Dai Nissei Kagaku Co., Ltd. was used. This water system emulsion was applied onto surface to be treated by a spraying method. A cover material 4 had a hardness of 67 on the Shore D Scale, and a coating layer 6 had a thickness of 100 $\mu$m and a hardness of 38 on the Shore D Scale.

In the above embodiments, precisely shaped, sharp-edged dimples were obtained, which were as precise and sharp as uncoated dimples of the conventional golf balls which have been just prepared by enclosing a core with a cover material, and then forming dimples thereon.

Further, the spin properties of the golf balls prepared were tested. As a result, the spin quantity given when hit with No. 1 Wood was the same as that given by a conventional low spin type golf ball, resulting in a spin property which can prevent the golf balls from being easily influenced by any wind. In addition, the spin quantity given when hit with a pitching wedge was the same as that given by a conventional high spin type golf ball, resulting in a spin property which can easily impart back spin.

What is claimed is:

1. A golf ball comprising; a core, a coating layer having a thickness of 50–250 $\mu$m as an outer layer, said coating layer is formed by dispersion coating using a water system emulsion which is prepared by dispersing a resin powder in water, said resin powder has a grain size 1–30 $\mu$m.

2. A golf ball according to claim 1, wherein said core is a solid core.

3. A golf ball according to claim 2, wherein said coating layer comprises a clear thermoplastic layer formed on said solid core.

4. A golf ball according to claim 1, further comprising a cover layer formed over said core.

5. A golf ball according to claim 4, wherein said coating layer comprises a clear thermoplastic layer formed on said cover layer.

6. A golf ball according to claim 1, wherein said coating layer comprises a thermoplastic or thermosetting white coating layer formed over said cover layer.

7. A golf ball according to claim 6, wherein said cover layer has a Shore D hardness harder than that of said coating layer.

8. A golf ball of claim 6, further comprising a transparent thermoplastic or thermosetting layer formed over said white coating layer.

9. A golf ball according to claim 1, wherein dimples are formed after the coating layer is formed by dispersion coating.

10. A golf ball according to claim 1, wherein a resin powder for preparing an emulsion to be applied by dispersion coating is selected from vinyl acetate resin powders, vinyl acetate copolymer resin powders, EVA (ethylene-vinyl acetate copolymer resin) powders, acrylic ester (co)polymer resin powders, epoxy resin powders, thermosetting urethane resin powders, and thermoplastic urethane resin powders.

11. A golf ball according to claim 1, wherein the golf ball comprises a main body and one or more coating layers formed on the main body, at least one of the coating layers being formed by dispersion coating.

12. A golf ball according to claim 11, wherein the main body is a solid core enclosed with a cover, a thread-wound core enclosed with a cover, or a solid core itself.

* * * * *